US006828876B1

(12) United States Patent
Brooks et al.

(10) Patent No.: US 6,828,876 B1
(45) Date of Patent: Dec. 7, 2004

(54) TAPERED DELAY LINE

(75) Inventors: Mark Brooks, North Mankato, MN (US); Hiroo Inoue, North Mankato, MN (US)

(73) Assignee: Thin Film Technology Corp., North Mankato, MN (US)

( * ) Notice: Subject to any disclaimer, the term of this patent is extended or adjusted under 35 U.S.C. 154(b) by 120 days.

(21) Appl. No.: 10/005,794

(22) Filed: Nov. 2, 2001

(51) Int. Cl.[7] ..... H01P 3/08
(52) U.S. Cl. ..... 333/161; 333/156; 333/140
(58) Field of Search ..... 333/156, 161, 333/140, 185, 116

(56) References Cited

U.S. PATENT DOCUMENTS 3,609,416 A * 9/1971 Epstein ..... 310/313 B
4,027,254 A * 5/1977 Gunton et al. ..... 333/109
4,452,084 A * 6/1984 Taenzer ..... 73/609
4,783,359 A * 11/1988 Fleischer et al. ..... 428/209
5,365,203 A * 11/1994 Nakamura et al. ..... 333/161
5,974,335 A * 10/1999 Talisa et al. ..... 505/210
6,346,863 B2 * 2/2002 Sasaki et al. ..... 333/116
2002/0130733 A1 * 9/2002 Iida et al. ..... 333/116
2002/0196101 A1 * 12/2002 Tsujiguchi ..... 333/175

* cited by examiner

*Primary Examiner*—Robert Pascal
*Assistant Examiner*—Kimberly Glenn
(74) *Attorney, Agent, or Firm*—DL Tschida

(57) ABSTRACT

Thin film devices having conductors of non-uniform line width and line spacing between adjacent conductors at uncoupled regions of symmetrical conductive pathways. Several coil-shaped delay line circuits are disclosed wherein the innermost and outermost conductors exhibit different line width and spacing between adjoining conductors. The devices are constructed on rigid and flexible, folding substrates and necessary terminations are connected with solder filled vias and/or edge connections.

17 Claims, 5 Drawing Sheets

TAPERED DELAY LINE

BACKGROUND OF THE INVENTION

The present invention relates to thin film delay lines and, in particular, to resistive, thin film circuit devices defined by symmetrical patterns containing conductive pathways of non-uniform width and spacing between adjacent conductors.

Varieties of thin film devices have been constructed for high frequency circuits. Most have been directed to microwave applications. Some devices, such as discrete delay line assemblies, have been constructed for higher frequency applications.

Delay lines are frequently used to adjust timing inconsistencies at complex circuitry mounted to complex printed circuit boards that operate at ever increasing higher frequencies. Desirably therefore any delay line should accommodate these higher frequency applications by exhibiting a constant impedance over the operating delay period. Secondarily, it is desirable that the devices can be produced at reduced sizes. Examples of some discrete, multi-layer, delay line devices constructed on ceramic substrates are shown at U.S. Pat. No. 5,030,931; 5,365,203; and 5,499,442.

The subject invention provides patterned thin film devices wherein the inductive and capacitive characteristics of the conductors that define the device are tailored by varying the line width and line spacing between adjacent conductors over the device. Several delay line circuits having a nominal 50 ohm impedance characteristic are disclosed wherein non-uniformities are formed in regions of the conductors that are not bordered on both sides by adjoining conductors, that is at the input or outermost and output or innermost conductors of a spiral patterned delay line. A reduced inductance of narrowed conductors is particularly offset with narrowed line spacing to reduce the capacitance and whereby the operating $Z_0$ of the delay lines is improved. Several alternative coil or spiral arrangements that exhibit different delays are disclosed that are constructed on rigid and flexible dielectric substrates. Necessary terminations are connected with solder filled vias and/or edge connections to the rigid or flexible substrate.

SUMMARY OF THE INVENTION

It is a primary object of the present invention to provide thin film devices having conductors of non-uniform line width and spacing between adjacent conductors to control the inductive and capacitive characteristics of the device.

It is a further object of the invention to provide thin film devices constructed from symmetrical conductor patterns, such as zigzag, serpentine, spiral or coil shapes, wherein regions of the conductors are formed with non-uniform line width and spacing between adjacent conductors to control the inductive-capacitive characteristics of the device.

It is a further object of the invention to provide alternative delay line circuits constructed from one or more coil shaped paths wherein the innermost and/or outermost conductors exhibit reduced or wider line widths and/or narrowed line spacing from other adjoining conductors.

It is a further object of the invention to provide a device with conductors of tailored shape and a ground plane of tailored thickness.

Various of the foregoing objects, advantages and distinctions of the invention can be found in alternative thin film delay line devices and circuits constructed on rigid and flexible/foldable ceramic substrates. Several coil shaped delay lines having a nominal 50 ohm impedance characteristic are defined by conductors of varying the line width and line spacing between adjacent conductors over the device. The conductor nonuniformities are formed in regions of the conductors that are not bordered on both sides by adjoining conductors.

Still other objects, advantages and distinctions of the invention will become more apparent from the following description with respect to the appended drawings. To the extent alternative constructions, improvements or modifications have been considered they are described as appropriate. The description should not be literally construed in limitation of the invention. Rather, the scope of the invention should be broadly interpreted within the scope of the further appended claims.

BRIEF DESCRIPTION OF THE DRAWINGS

Like reference numerals refer to like structure at the various drawings and which are as follows.

DESCRIPTION OF THE PREFERRED EMBODIMENT

Figure 1:
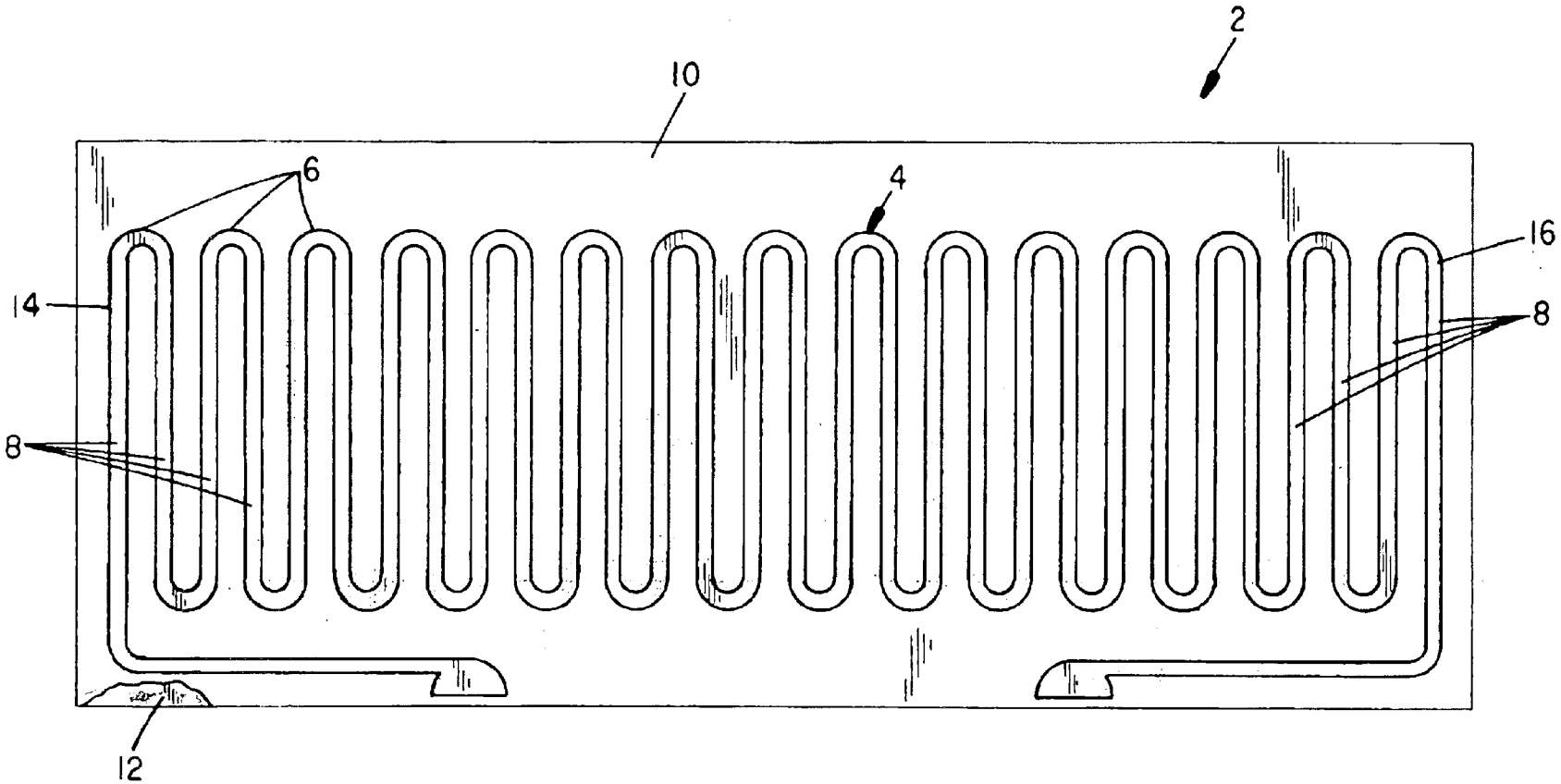
FIG. 1 (PRIOR ART)
FIG. 1 is a diagram of a typical "prior art" thin film delay line.

Referring to FIG. 1, a typical prior art delay line device 2 is shown. The device 2 is defined by a patterned, conductive signal path 4 having a number of zig-zag or serpentine convolutions 6 that are symmetric with respect to each other. Each convolution 6 includes a linear portion 8 that extends parallel to an adjoining neighbor and is constructed using conventional thin film processes as distinguished from integrated circuit processes. The width of each convolution 6 is the same as the others and the spacing between each linear portion 8 is the same.

The electrically conductive signal path 4 is defined by a thin film that is deposited and patterned using conventional plating, sputtering, cvp deposition or the like and compatible photolithography and etching techniques to derive the conductive path 4. It is to be appreciated the path 4 can take myriad forms wherein the conductors wind back and forth upon each other. Each convolution 6 can also include several sub-convoluted paths and the pattern of which are repeated.

The patterned signal path 4 is constructed on a top surface of a dielectric substrate 10, foe example, a resin board, ceramic oxide, zirconia-tin-titanate or other material having a desirable dielectric characteristic. A suitable ground plane 12, shown in cutaway at FIGS. 1–4, is deposited on the bottom surface of the substrate 10.

The time delay $T_d$ of the device 2 is a function of the self and mutual inductance of the conductive paths 8 and the parallel plate and fringe capacitance between the several adjoining conductive paths 8 and ground plane 12, that is, $T_d=\sqrt{LxC}$. At operating frequencies in excess of 200 MHz, the impedance ($Z_0$) characteristic of the device varies over time, since the inductance contributed by the outermost end conductors 14 and 16 is relatively less than the inner conductors. That is, there are fewer adjoining conductors to couple with at the input and output ends and therefore less mutual inductance. Signal artifacts thus appear when measuring the impedance characteristic of the device. At the relatively high operating frequencies at which delay lines are now commonly implemented, the spurious signal artifacts can affect the performance of the principal circuitry with which the delay line is coupled.

Because it is desirable to maintain a constant impedance $Z_0$ during the entire period of the time delay and appreciating that $Z_0=\sqrt{L/C}$, attempts have been made to reduce the spacing between relatively unbounded or uncoupled conductors of circuits having uniform conductor widths. Other attempts have been directed to reduce the inductance and line width of uncoupled conductors and simultaneously reduce the capacitance of the uncoupled conductors to offset the reduced inductance to maintain $Z_0$.

Figure 2:
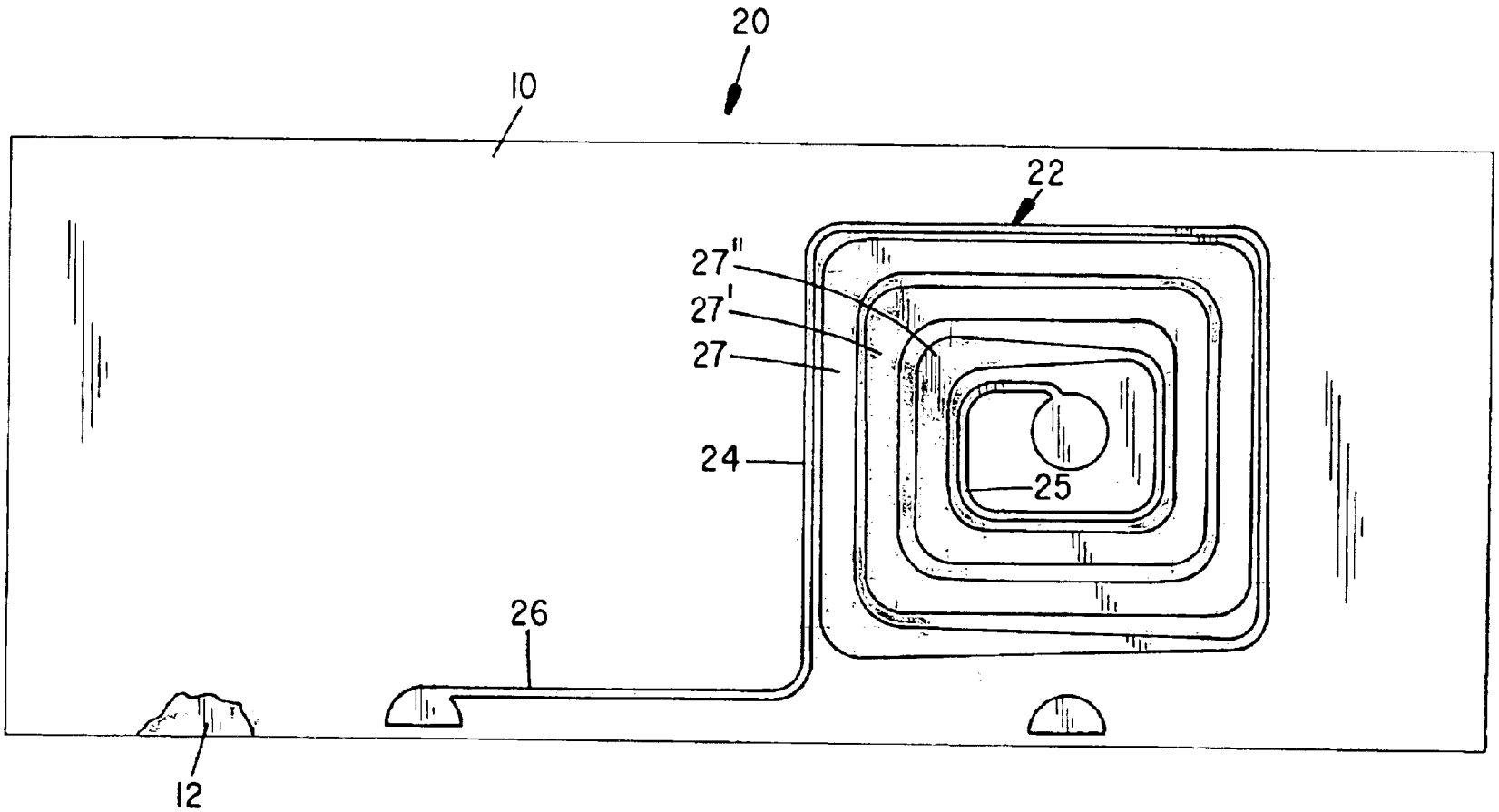
FIG. 2 is a diagram of a 0.9 nsec tapered delay line.
Figure 3:
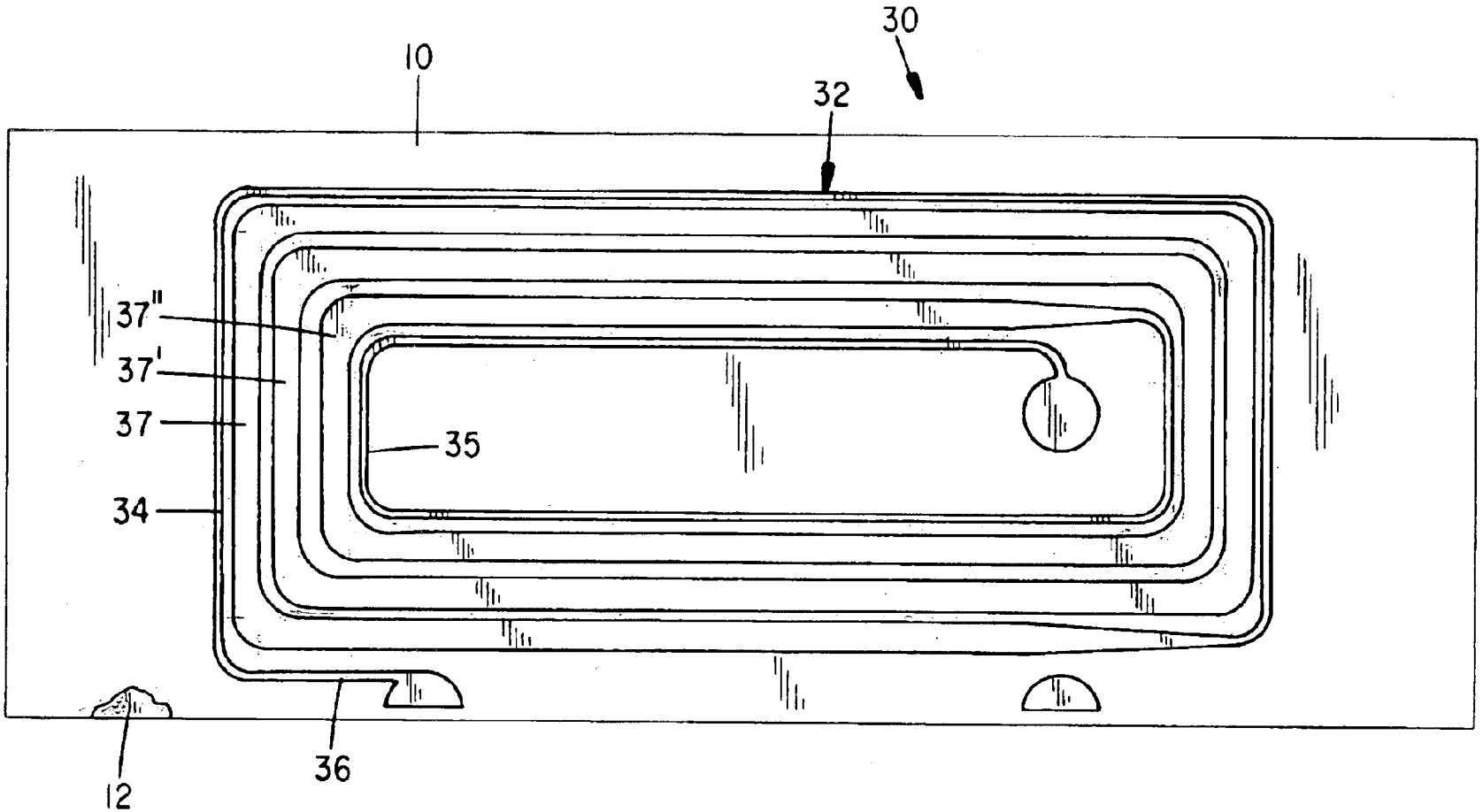
FIG. 3 is a diagram of a 1.8 nsec tapered delay line.
Figure 4:
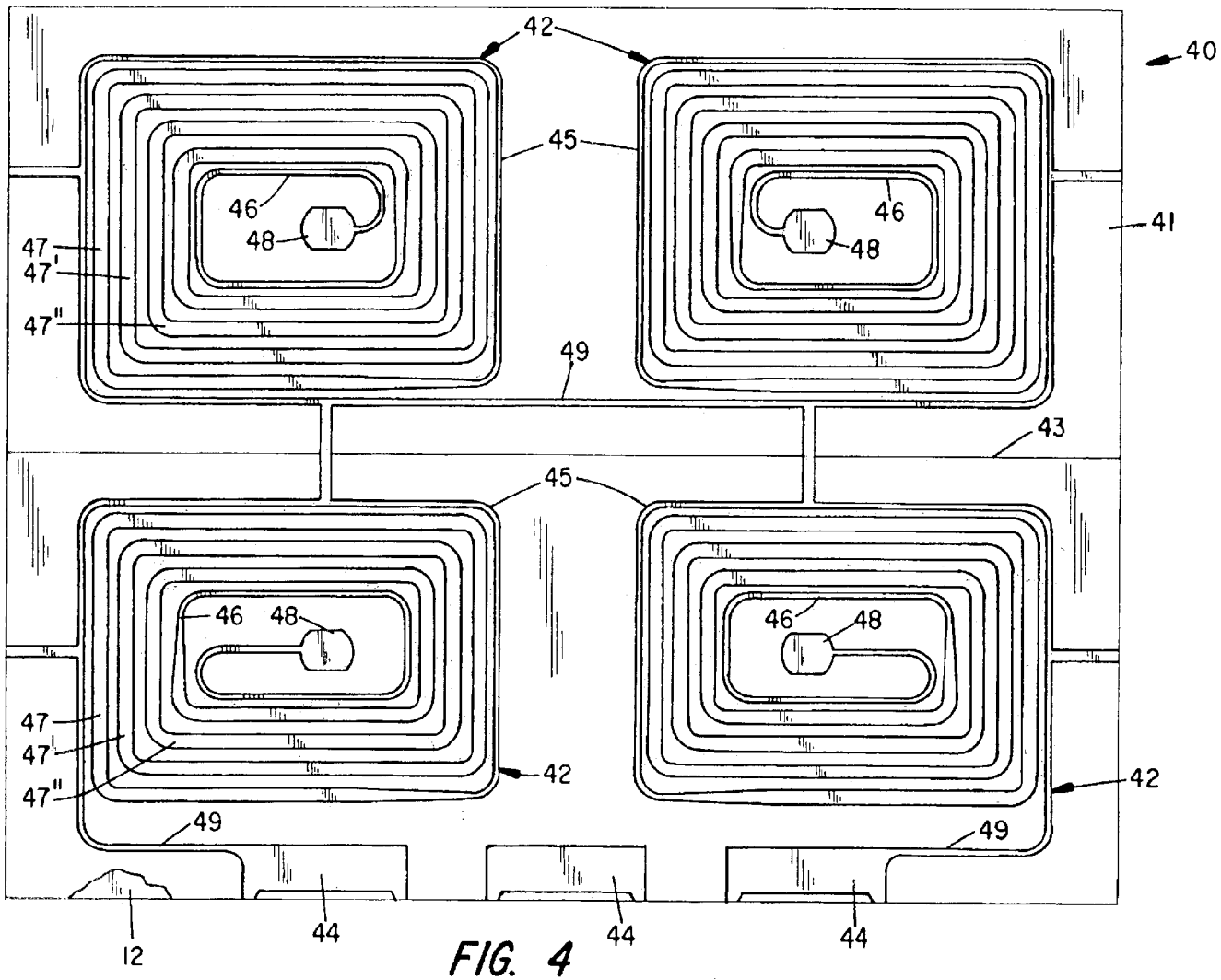
FIG. 4 is a diagram of a 4.25 nsec folding, tapered delay line.

In the latter regard, the outermost and innermost conductors of the coil shaped delay line circuits 20, 30 and 40 of FIGS. 2–4 have been modified at the input and output ends. That is, the line width of the outermost, input end and innermost, output end conductors have been reduced and the spacing relative to the nearest adjoining conductor has been reduced. Device performance has thereby been improved (i.e. a relatively smoother impedance $Z_0$ characteristic is created) as exemplified by the comparative waveforms shown at FIG. 5 for the device 40.

Figure 5:
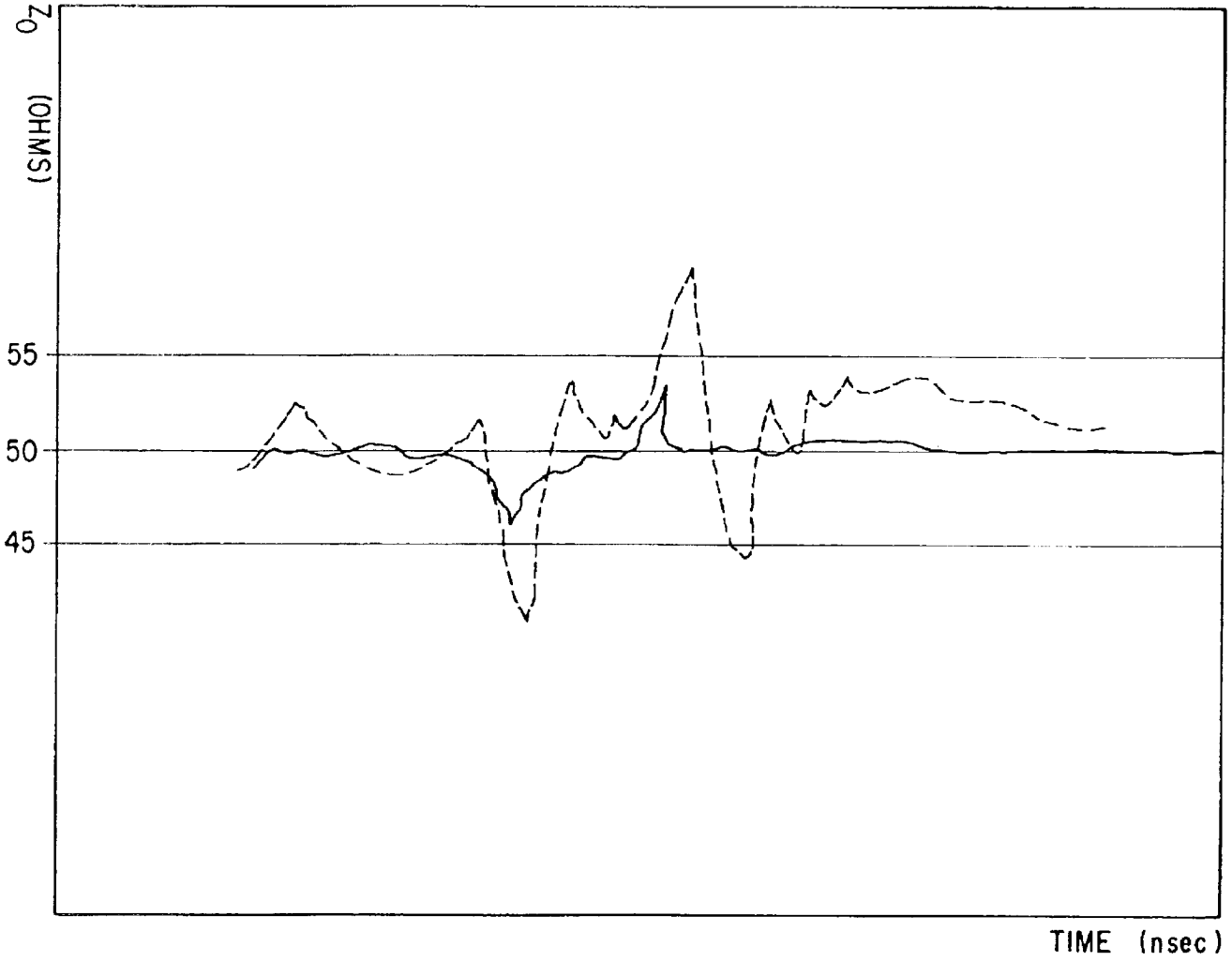
FIG. 5 shows an exemplary signal waveform for a delay line device of FIG. 4 in solid line relative to a similar device (shown in dashed line) having a conventional conductor pattern of geometrically identical shape but wherein all conductive paths exhibit the same width and inter-conductor spacing.

FIG. 5 particularly exemplifies the impedance characteristic exhibited by a test signal impressed on two nominal 2.0 nanosecond delay lines. The signal shown in dashed line is that of a delay line constructed in conventional fashion with conductors of uniform line width and line spacing. The solid line signal is exhibited by a delay line of identical pattern but constructed with the improved (i.e. tailored line shape/line spacing) conductors of the devices 20, 30 and 40 of FIGS. 2–4. FIG. 5 demonstrates the relatively smoother impedance characteristic and reduced peak-to-peak swing of $Z_0$ that is obtained by tailoring the conductors.

Each of the improved devices of FIGS. 2–4 provides non-uniform line width and line spacing at the outermost (input end) and innermost (output end) conductor coils and coupling conductors. With attention to FIG. 2, the device 20 provides a square coil shaped conductive path 22 wherein the interior coils 27, 27' and 27" are each sized at a nominal 0.240 inch line width and a 0.160 inch spacing between the interior coils 27, 27' and 27". Relatively thinner outermost and innermost conductors 24 and 25 are formed with a nominal 0.060-inch line width and a 0.080-inch spacing between the coils 24–27 and 25–27". The reduced capacitance exhibited by the conductors 24, 25 and 26 offsets the comparatively low inductance of the uncoupled conductors 24 and 25 such that the device 20 exhibits a substantially uniform 50-ohm impedance to signals coupled to the device 20. The line width and/or line spacing of the device conductors wherever they are uncoupled from other parallel conductors. It may also be desirable to tailor the thickness of the ground plane 12 in the regions of a device's coupled and uncoupled conductors to control the capacitance.

FIG. 3 is depicts a coiled delay line device 30 having a nominal 1.8 nanosecond delay. Where the path 22 is generally configured in a square shape, the conductive path 32 exhibits a rectangular shape. The input coil 34, output coil 35 and coupling conductor 36 each exhibit a nominal 0.060 inch line width and a 0.070 inch spacing between the coils 34–37 and 35–37". The coil conductors 37, 37' and 37" are formed with a nominal 0.230-inch line width and a 0.100-inch spacing between the coils 37, 37' and 37".

FIG. 4 depicts another coiled delay line device 40 having a nominal 4.25 nanosecond delay. The device 40 is constructed in a folding configuration on a flexible substrate 41. A number of coiled delay line segments 42, each similar to the device 20, are distributed about the surface of the substrate. A longitudinal fold line 43 extends between the segments 42 and terminations 44 are provided at the edges of the substrate 41.

An input coil 45, output coil 46 and coupling conductors 49 exhibit a nominal 0.060-inch line width and a 0.080 inch spacing between the coils 45–47 and 46–47". The coil conductors 47, 47' and 47" are formed at a nominal 0.150-inch line width and a 0.150-inch spacing between the coils 47, 47' and 47". Plated through vias (not shown) couple terminations 48 to each other in an appropriate fashion.

While the invention has been described with respect to a number of presently preferred delay line devices, the invention can be adapted to a variety of other transmission line circuit components wherein it is desired to obtain a substantially constant operating impedance at frequencies greater than 100 MHz. The geometric configuration of the device's conductor pathway can take any desired form, thus the disclosed coil-shaped delay lines should not be held as limiting. It is also to be appreciated the shaping of the line width and line spacing can be selectively relegated to selected regions of the pathway as opposed all uncoupled regions. It is to be appreciated still other circuit and device constructions may be suggested to those skilled in the art. The scope of the invention should therefore be construed broadly within the spirit and scope of the following claims.

What is claimed is:

1. Thin film apparatus comprising:

a) a signal layer including a continuous signal conductor deposited on a first surface of a dielectric substrate, wherein the signal conductor is defined by a plurality of geometrically similar pathway portions that extend from a proximal end to a distal end of said signal conductor in adjoining relation to one another, wherein said plurality of pathway portions are positioned to electrically interact with each other, wherein first and second sections of said signal conductor that terminate at said proximal and distal ends exhibit a conductor width that is less than the conductor width of the intervening ones of said plurality of pathway portions, and wherein the spacing between said first and second sections to the adjoining ones of said plurality of pathway portions is less than the spacings between the others of said plurality of pathway portions;

b) a ground plane layer deposited on a second surface of said dielectric substrate; and c) termination means for coupling electrical signals to said signal conductor and said ground plane conductor.

2. Apparatus as set forth in claim 1 wherein said signal conductor and said ground layer are sputtered onto a ceramic substrate.

3. Apparatus as set forth in claim 1 wherein said signal conductor comprises a plurality of serpentine windings that define a delay line.

4. Apparatus as set forth in claim 1 wherein said signal conductor defines a delay line.

5. Apparatus as set forth in claim 1 wherein said substrate comprises a flexible material and said signal conductor is partitioned such that said substrate can be folded during packaging.

6. Apparatus as set forth in claim 1 wherein said signal conductor exhibits a symmetrical pattern.

7. Apparatus as set forth in claim 1 wherein said signal conductor exhibits a planar coil shape comprising a plurality of windings that extend from an unbounded outer proximal end to a bounded interior distal end in parallel relation to one another.

8. Apparatus as set forth in claim 7 wherein said first and second sections each exhibit a tapering width substantially identical to the other.

9. Apparatus as set forth in claim 1 wherein said signal conductor is partitioned into a plurality of interconnected planar coils and wherein each coil includes a plurality of windings that extend from an outer proximal end unbounded by adjoining windings to a bounded interior distal end in parallel relation to one another and wherein the conductor width of said outer and interior ends of each of the interconnected coils is less than the width of adjoining windings.

10. Apparatus as set forth in claim 9 wherein the spacing between outer and interior ends of each interconnected coil to an adjacent winding is less than the spacing between the others of said plurality of said windings.

11. Thin film apparatus comprising:

a) a signal layer including a continuous signal conductor deposited on a first surface of a dielectric planar substrate, wherein the signal conductor is defined by a coiled pathway having a plurality of windings that extend from an outer end unbounded by said plurality of windings to a bounded interior end in parallel relation to one another, wherein the width of the portions of said windings terminating at said outer and interior ends is less than the width of the others of said plurality of windings;

b) a ground plane layer deposited on a second surface of said dielectric substrate to substantially cover the second surface; and c) termination means for coupling electrical signals to said signal conductor and said ground plane conductor.

12. Apparatus as set forth in claim 4 wherein said substrate comprises a flexible material and said signal conductor is partitioned into a plurality of coiled sections that are arranged such that said substrate can be folded during packaging to stack said coiled sections one upon another.

13. Apparatus as set forth in claim 11 wherein the spacings between the portions of said windings terminating at said outer and interior ends is less than the spacing between the others of said plurality of windings.

14. Apparatus as set forth in claim 11 wherein the pathway portions terminating at said proximal and distal ends each exhibit a tapering width substantially identical to the other.

15. Delay line apparatus comprising:

a) a signal layer including a continuous signal conductor deposited on a first surface of a dielectric planar substrate, wherein the signal conductor is defined by a plurality of pathway portions that extend from a proximal end to a distal end in parallel relation to one another, wherein said plurality of pathway portions are positioned to electrically interact with each other, wherein first and second sections of the pathway portions terminate at said proximal and distal ends, wherein said first and second sections exhibit a tapering width that is less than the width of the others of said plurality of pathway portions, and wherein the spacing between said first and second sections to the adjoining pathway portions is less than the spacing between the others of said plurality of pathway portions;

b) a ground plane layer deposited on a second surface of said dielectric substrate to substantially cover the second surface; and c) termination means for coupling electrical signals to said signal conductor and said ground plane conductor.

16. Apparatus as set forth in claim 15 wherein said substrate comprises a flexible material and said signal conductor is partitioned into a plurality of coiled sections that are arranged such that said substrate can be folded during packaging to stack said coiled sections one upon another.

17. Thin film apparatus comprising:

a) a signal layer including a continuous signal conductor deposited on a first surface of a dielectric substrate, wherein the signal conductor is defined by a plurality of symmetrical pathway portions of identical shape that extend from a proximal end to a distal end in parallel relation to one another, wherein said plurality of pathway portions are positioned to electrically interact with each other, wherein the spacing between first and second sections of the pathway portions that terminate in said proximal and distal ends to the adjoining pathway portions is less than the spacing between the others of said plurality of pathway portions;

b) a ground plane layer deposited on a second surface of said dielectric substrate to substantially cover the second surface; and c) termination means for coupling electrical signals to said signal conductor and said ground plane conductor.

* * * * *